US005139099A

United States Patent [19]

Hayashi et al.

[11] Patent Number: 5,139,099

[45] Date of Patent: Aug. 18, 1992

[54] EXCAVATION TOOL

[75] Inventors: Takeshi Hayashi; Shigeru Sato; Katsuaki Tsujimoto; Daishiro Miyazaki; Yoneo Hiwasa, all of Anpachi; Toshiki Ishimatsu, Tokyo; Kimiyo Wada, Toyohashi, all of Japan

[73] Assignee: Mitsubishi Materials Corporation, Tokyo, Japan

[21] Appl. No.: 736,725

[22] Filed: Jul. 26, 1991

[30] Foreign Application Priority Data

Jul. 27, 1990 [JP] Japan ..... 2-200354

[51] Int. Cl.[5] ..... E21B 10/32; E21B 10/38; E21B 10/62; E21B 10/52

[52] U.S. Cl. ..... 175/292; 175/296; 175/384; 175/413; 175/415; 175/418

[58] Field of Search ..... 175/258, 292, 296, 384, 175/412, 413, 415, 418, 410

[56] References Cited

U.S. PATENT DOCUMENTS

| | | | |
|---|---|---|---|
| 1,754,525 | 4/1930 | Raymond | 175/292 |
| 1,776,018 | 5/1932 | Charlton | 175/267 |
| 1,839,588 | 1/1932 | Raymond | 175/292 |
| 1,858,263 | 9/1932 | Brown | 175/292 |
| 3,185,228 | 5/1965 | Kelly, Jr. | 175/415 X |
| 3,522,852 | 8/1970 | Bardwell | 175/384 |
| 3,536,150 | 8/1970 | Stebley | 175/412 X |
| 4,874,046 | 10/1989 | Hurd | 175/292 |
| 5,052,503 | 10/1991 | Löf | 175/292 X |

FOREIGN PATENT DOCUMENTS

| | | |
|---|---|---|
| 550100 | 12/1942 | United Kingdom . |
| 21322527 | 7/1984 | United Kingdom . |

*Primary Examiner*—Stephen J. Novosad
*Attorney, Agent, or Firm*—Scully, Scott, Murphy & Presser

[57] ABSTRACT

An excavation tool, in which a device is provided which receives the striking force of a hammer and the rotational force of a hammer cylinder, in a bottom surface of which at least three axle holes are provided displaced from a center of the device and at equivalent angular intervals in the circumferential direction, block axles are inserted in the axle holes in a freely rotatable manner, blocks which are roughly fan-shaped and have bits embedded in the lead end surfaces thereof are provided at lead end parts of the block axles, so that left- and right-side faces of said blocks are in mutual opposition and arc parts of all blocks together form roughly a circle shape; and when said device is rotated in the direction of excavation, said blocks rotate as a result of the resistance to excavation of the bottom part of the excavation hole, one intersection part of the side faces and the arc part of each block protrudes beyond the outer circumferential surface of the device by a predetermined excavation amount, and the mutual positions of the block axles with respect to the blocks are so determined that both side faces of each block come into contact with the side faces of neighboring blocks at this time.

11 Claims, 5 Drawing Sheets

C

EXCAVATION TOOL

BACKGROUND OF THE INVENTION

1. Field of the Invention

The present invention relates to an excavation tool for use in the excavation of earth and sand, such as the digging of wells or the construction of foundation piling holes and the like.

2. Prior Art

Conventionally, a type of excavation toll for the excavation of earth and sand was known in which a pilot bit was provided at the lead end of an excavation pipe, by means of this pilot bit the bottom surface of an excavation hole was excavated and the diameter of the excavation hole was widened by means of an eccentric reamer disposed at the upper part of this pilot bit, and using the widened part of the excavation hole, the excavation pipe was advanced. However, in this type of excavation tool, a part of the circumference of the excavation hole was re-excavated by means of the eccentric reamer, and an eccentric hole thus created, so that there was a disadvantage in that the excavation hole bent easily.

Recently, excavation tools such as that disclosed in Japanese Patent Application, first publication, Laid open No. Sho. 63-11789 have been developed in order to solve this problem.

As shown in FIGS. 1 through 3, this excavation tool is provided with a device 2 which receives the striking force of a hammer (not depicted in the diagram) and the rotational force of a hammer ring 1; two axle holes 2*a* and 2*b* are formed in the bottom surface thereof which are in point symmetry with respect to the center of device 2, and block axles 3*a* and 3*b* are inserted into these axle holes 2*a* and 2*b* in a freely rotatable and firmly attached manner. At the lead end parts of these block axles 3*a* and 3*b*, blocks 5*a* and 5*b*, which have roughly the same diameter as that of the above device 2, are roughly semicircular in shape, and have embedded in lead end surfaces thereof a plurality of bits 4..., are provided with the straight edge surfaces 6*a* and 6*b* thereof in mutual opposition. When the above device 2 rotates in the direction of excavation, the positions of the above block axles 3*a* and 3*b* are such that one end of each of the above blocks 5*a* and 5*b* protrudes beyond the outer circumferential surface of device 2 by a predetermined excavation amount, and at this time, the straight edge surfaces 6*a* and 6*b* of the blocks are displaced from the center of device 2 so that they are in mutual contact.

When device 2 is rotated in the direction of excavation X by means of hammer ring 1, in the above excavation tool, blocks 5*a* and 5*b* rotate about block axles 3*a* and 3*b* while receiving excavation resistance, one end of the straight edge surfaces 6*a* and 6*b* of blocks 5*a* and 5*b* protrudes beyond the outer circumferential surface of device 2 by a prescribed amount, a part of straight edge surfaces 6*a* and 6*b* come into mutual contact and stop the rotation of blocks 5*a* and 5*b*, and in this state, blocks 5*a* and 5*b* receive the rotational force of device 2, earth is excavated by means of bits 4..., and advancement is made into the earth by means of the striking force of the hammer.

At this time, the earth and sand and the like which is excavated is separated from the lead end of the excavation tool by means of the blowing of compressed air, expelled at the time of the falling of the piston hammer within hammer cylinder 1, from airholes 8*a* and 8*b* provided in the bottom surface of device 2, and after this, the earth and sand and the like is moved to the interior of excavation pipe 9 through exhaust grooves 9*a* and is finally expelled in an upwards direction.

In the above excavation tool, as shown in FIG. 2, earth is excavated by means of a part of blocks 5*a* and 5*b* which protrudes in an outward direction beyond the outer circumferential surface of device 2 (hereinafter termed the outer circumferential blade A); these outer circumferential blades A are only present at two points separated by 180 degrees and beyond the outer circumferential surface of device 2. This excavation tool is superior to the eccentric hole excavating type discussed above; however, it is incapable of balanced excavation, so that for example in the case in which layers of uneven quality are excavated, there is a danger that hole bending will be produced.

Furthermore, as shown in FIG. 2, when an excavation counterforce C which is parallel to straight edge surfaces 6*a* and 6*b* is placed on blocks 5*a* and 5*b* from the inner circumferential surface of the excavation hole, the friction between straight edge surfaces 6*a* and 6*b* is negligibly small, so that almost all the excavation counterforce C acts on block axle 3*a*(3*b*) through the medium of the blocks, and a great load is placed on block axle 3*a*(3*b*).

Furthermore, an appropriate amount of play is provided between axle holes 2*a* and 2*b* and block axles 3*a* and 3*b* so that the block axles are able to rotate; however, when the above-described excavation counterforce C is placed on blocks 5*a* and 5*b*, rattling is produced in blocks 5*a* and 5*b* along straight edge surfaces 6*a* and 6*b* in accordance with the extent of the above play, and since it is impossible to firmly fasten the blocks in this manner, the lifespan of the tool is shortened, and excavation efficiency declines.

Summary of the Invention

The present invention was designed to solve the above problems; it has as a purpose thereof to provide an excavation tool which reduces the incidence of unwanted hole bending, and makes possible a reduction in the amount of force placed on the block axles, a lengthening of tool life, and an increase in excavation efficiency.

In order to achieve the above object, in the excavation tool of the present invention, in the bottom surface of the device 2, which receives the striking force of the hammer and the rotation force of the hammer cylinder, at least three axle holes 2*a*, 2*b*, and 2*c* are provided displaced from the center of the device 2 and at equal angles in the circumferential direction, block axles 3*a*, 3*b*, and 3*c* are engaged in a freely rotatable manner in these axle holes 2*a*, 2*b*, and 2*c*, and at the lead end part of each block axle, blocks 11*a*, 11*b*, and 11*c* having roughly a fan shape and in the lead end surfaces of which bits 4 are embedded are provided in such a manner that the side faces 12*a* and 12*b* thereof contact each other, and moreover, the arc parts of these blocks 11*a*, 11*b*, and 11*c* roughly form a circle. When the device 2 is rotated in the direction of excavation, the blocks 11*a*, 11*b*, and 11*c* rotate by means of the resistance to excavation of the excavation hole bottom, one of the intersection parts of the side faces 12*a* and 12*b* and arc part of each of the blocks protrudes beyond the outer circumferential surface of the device 2 by a predetermined excavation amount, and at this time, the mutual positioning of the block axles 3a, 3b, and 3c corresponding to the blocks 11a, 11b, and 11c is designed so that the side faces 12a and 12b of the blocks 11a, 11b, and 11c are in contact with the side faces 12a and 12b of the neighboring blocks 11a, 11b, and 11c.

In the excavation tool described above, when the hammer cylinder rotates in the direction of excavation, the device 2 also rotates as a unit. Furthermore, by means of the descent of the hammer piston, the device 2 and the blocks 11a, 11b, and 11c which are attached to the lead end thereof advance.

When the device 2 rotates in the direction of excavation, the blocks 11a, 11b, and 11c rotate around the various block axles 3a, 3b, and 3c as a result of excavation resistance, one of the intersection parts of the side faces 12a and 12b and the arc part of each of the blocks 11a, 11b, and 11c protrudes beyond the outer circumferential surface of the device 2 by a predetermined excavation amount, this part becomes an outer circumferential blade A, and excavates the hole. Furthermore, when the above-described blocks 11a, 11b, and 11c rotate, the side faces 12a and 12b of each block are in contact with the side faces 12a and 12b of the neighboring blocks 11a, 11b, and 11c, and this has a mutual stopper function, so that further rotation of each block is controlled.

Here, three or more blocks 11a, 11b, and 11c are provided, so that three or more outer circumferential blades A, each of which corresponds to one block, are created, and moreover, these outer circumferential blades A are created with equal spacing in the circumferential direction. As a result, well-balanced excavation can be executed, so that hole bending is unlikely to occur even in ground having uneven qualities.

Furthermore, at the time of excavation, as a result of the combination of the contact of the left and right side faces 12a and 12b of the blocks 11a, 11b, and 11c with the side faces 12a and 12b of the neighboring blocks 11a, 11b, and 11c, and the engaging of the block axles 3a, 3b, and 3c which are affixed to the blocks 11a, 11b, and 11c in the axle holes 2a, 2b, and 2c, support is achieved at three points. Accordingly, strong affixing of the blocks 11a, 11b, and 11c can be conducted, rattling is unlikely to occur during excavation, and excellent excavation can be conducted.

Furthermore, as a result of providing a number of outer circumferential blades A as stated above, and as a result of the firm support of the blocks 11a, 11b, and 11c, tool life is extended.

In addition, in the case in which an excavation counterforce C which acts parallel to the side faces 12a and 12b and the lead end surfaces is placed on the blocks 11a, 11b, and 11c, this excavation counterforce C is divided among the block axle which supports the block 11a, 11b, and 11c and the other blocks 11a, 11b, and 11c, so that it is possible to reduce the load which is placed on the block axles 3a, 3b, and 3c.

Furthermore, the excavation counterforce which is placed on the blocks 11a, 11b, and 11c finally acts on the block axles 3a, 3b, and 3c which support these blocks 11a, 11b, and 11c; however, as a plurality of these block axles 3a, 3b, and 3c are disposed in a balanced manner in the circumferential direction in the bottom surface of the device 2, the support strength of the blocks 11a, 11b, and 11c as a whole is increased.

In addition, as three or more blocks 11a, 11b, and 11c are provided, in comparison with the case in which only two blocks 11a, 11b, and 11c are provided, the rotational angle of the blocks 11a, 11b, and 11c at the time of the movement of the blocks 11a, 11b, and 11c from a non excavating state to an excavating state or vice versa is small, so that the movement becomes smooth as a result. Furthermore, it is possible to provide a number of excavated matter exhaust holes formed in the bottom surface of the device 2 in correspondence with the number of blocks 11a, 11b, and 11c, so that the exhaust efficiency of excavated matter increases.

Furthermore, an air exhaust hole 17 extending in the axial direction is formed in the center of the device 2, and passage holes 27 having openings in the lead end surfaces of the blocks 11a, 11b, and 11c and extending in the axial direction of the block axles are formed, the depth of the axle holes 2a, 2b, and 2c is so set as to be greater than the length of the block axles 3a, 3b, and 3c, and connecting holes 24 which connect the air exhaust holes 17 and axle holes 2a, 2b, and 2c are formed in the device 2, so that the air which is compressed by means of the descent of the hammer flows into the air exhaust holes 17, through the connecting holes 24, and is emitted from the passage holes 27, so that excavated matter can be efficiently removed. Furthermore, the air exhaust holes 17 and the axle holes 2a, 2b, and 2c are connected by means of connecting holes, so that the axle holes 2a, 2b, and 2c are positively pressurized with respect to the vicinity of the lead end surface of the blocks 11a, 11b, and 11c, that is, with respect to the vicinity of the bits 4, so that it is possible to prevent the entry of excavated matter into the axle holes 2a, 2b, and 2c.

Furthermore, an air exhaust hole 17 which extends in the axial direction is formed in the center of the device 2, and this air exhaust hole 17 is connected through the medium of side holes 19 to airholes 20 which have openings in the bottom surface of the device 2, and in addition, excavated matter exhaust grooves 23 are formed in the outer circumferential surface of the device 2, and in the bottom surface of the device 2, notches 21 are provided which communicate the excavated matter exhaust grooves 23 and the airholes 20, so that the air which is compressed by means of the descent of the hammer flows from the air exhaust holes 17 and is emitted from the airholes 20, removing the excavated matter. Notches 21 which are connected to the excavated matter exhaust grooves 23 are formed in the lead end of the airholes 20, so that a part of the compressed air flows directly, and aids in the expulsion of the excavated matter, so that it is possible to efficiently remove the excavated matter. In addition, at the time of the diameter-reduction operation of the blocks 11a, 11b, and 11c, by means of the blowing of compressed air onto the surfaces of the device 2 and the blocks 11a, 11b, and 11c which are in contact, it is possible to effectively remove the excavated matter from these contact surfaces, and thus to remove the resistance at the time of the reduction of block diameter.

Furthermore, angled surfaces 15 a, 15b, and 15c having an angle with respect to the side faces 12a and 12b and lead end surfaces of the blocks 11a, 11b, and 11c are provided at one crossing point of the side edge and lead edge surfaces of each block, and a portion of the bits 4 are embedded in these angled surfaces 15a, 15b, and 15c nearly horizontally with respect to these surfaces, so that the combined force of the rotational counterforce at the time of excavation and the counterforce of the striking force, which is perpendicular to this rotational counterforce, act roughly at right angles to the bits 4 embedded in the angled surfaces 15*a*, 15*b*, and 15*c* , so that it is possible to prevent damage or removal of these bits 4.

In addition, the outer circumference of the blocks 11*a*, 11*b*, and 11*c* is formed by arcs $S_1$ and $S_2$ having differing radiuses, and the radius of the outer circumference of the side of the block which protrudes beyond the outer circumferential surface of the device 2 when the device 2 is rotated in the direction of excavation is greater than the radius of the outer circ of the side of the block which does not protrude, so that it is possible to embed a plurality of bits 4 in the protruding-side part, and accordingly, even if the amount of work of the part of the block which protrudes, that is, the part which achieves a predetermined hole diameter, is large, it is possible to prevent the complete abrasion of the bits 4 which are embedded in the protruding part before the abrasion of the bits 4 which are embedded in the non-protruding part, so that it is possible to increase the life of the excavation tool.

In addition, the block axles 3*a*, 3*b*, and 3*c* and the blocks 11*a*, 11*b*, and 11*c* are combined so as to be mutually dismemberable, so that it is possible to manufacture the block axles 3*a*, 3*b*, and 3*c* and the blocks 11*a*, 11*b*, and 11*c* separately. Accordingly, the difficulties involved in the unitary formation of the block axles 3*a*, 3*b*, and 3*c* and blocks 11*a*, 11*b*, and 11*c* are not encountered, so that it is possible to keep the manufacturing costs of the excavation tool low.

Furthermore, the fatigue strength of the block axles 3*a*, 3*b*, and 3*c* is set so as to be greater than that of the blocks 11*a*, 11*b*, and 11*c*, so that even when bending stress which fluctuates primarily over time acts on the block axles 3*a*, 3*b*, and 3*c* at the time of excavation, the breaking of block axles prior to the limit of use of the blocks can be prevented.

Furthermore, between a first sloping surface 13*a*, 13*b*, and 13*c*, which slopes downwardly from the arc-form ridge line of the flat surface of the lead end of the block in the direction of the circumference of the device 2, and a second sloping surface 14*a*, 14*b*, and 14*c*, which slopes downwardly from the arc-form ridge line of the outer side of the first sloping surface 13*a*, 13*b*, and 13*c* in the direction of the circumference of the device 2, a step 112 is provided, so that it is possible to maintain the spacing between the bits 4 embedded in these first and second sloping surfaces 13*a* and 14*a*, so that it becomes possible to embed a number of bits 4, and thus to increase excavation efficiency.

BRIEF DESCRIPTION OF THE DRAWINGS

FIG. 1 is a cross-sectional view of the excavation tool,, and FIGS. 2 and 3 are bottom views of the blocks.

FIG. 1 is a semi cross-sectional view of the device with the blocks attached thereto, FIG. 5 is a bottom view of the blocks when excavation is not being conducted, FIG. 6 is a bottom view of blocks during excavation, and FIG. 7 is a cross-sectional view of the main parts of the excavation tool at the time of excavation.

DETAILED DESCRIPTION OF THE PREFERRED EMBODIMENTS

Figure 2:
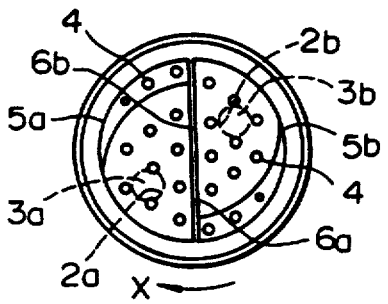
FIGS. 1 to 3 show an example of a conventional excavation tool.
Figure 3:
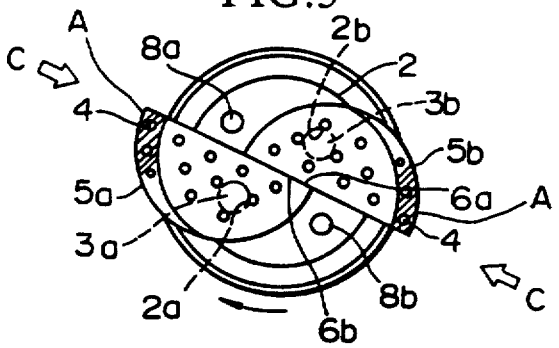
Figure 1:
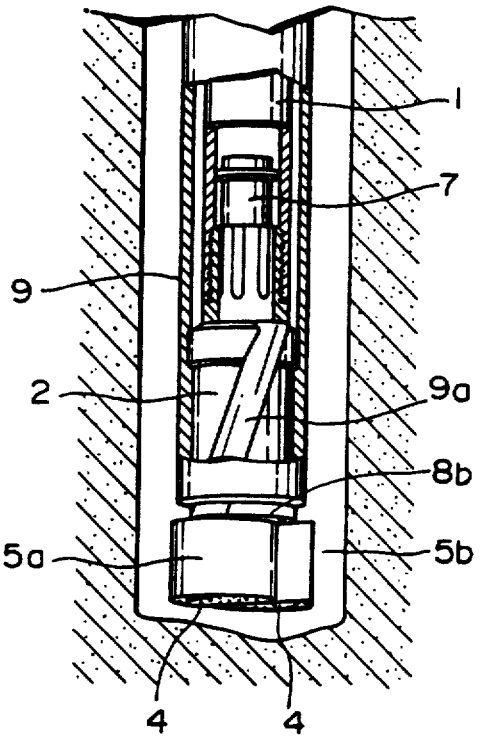
Figure 4:
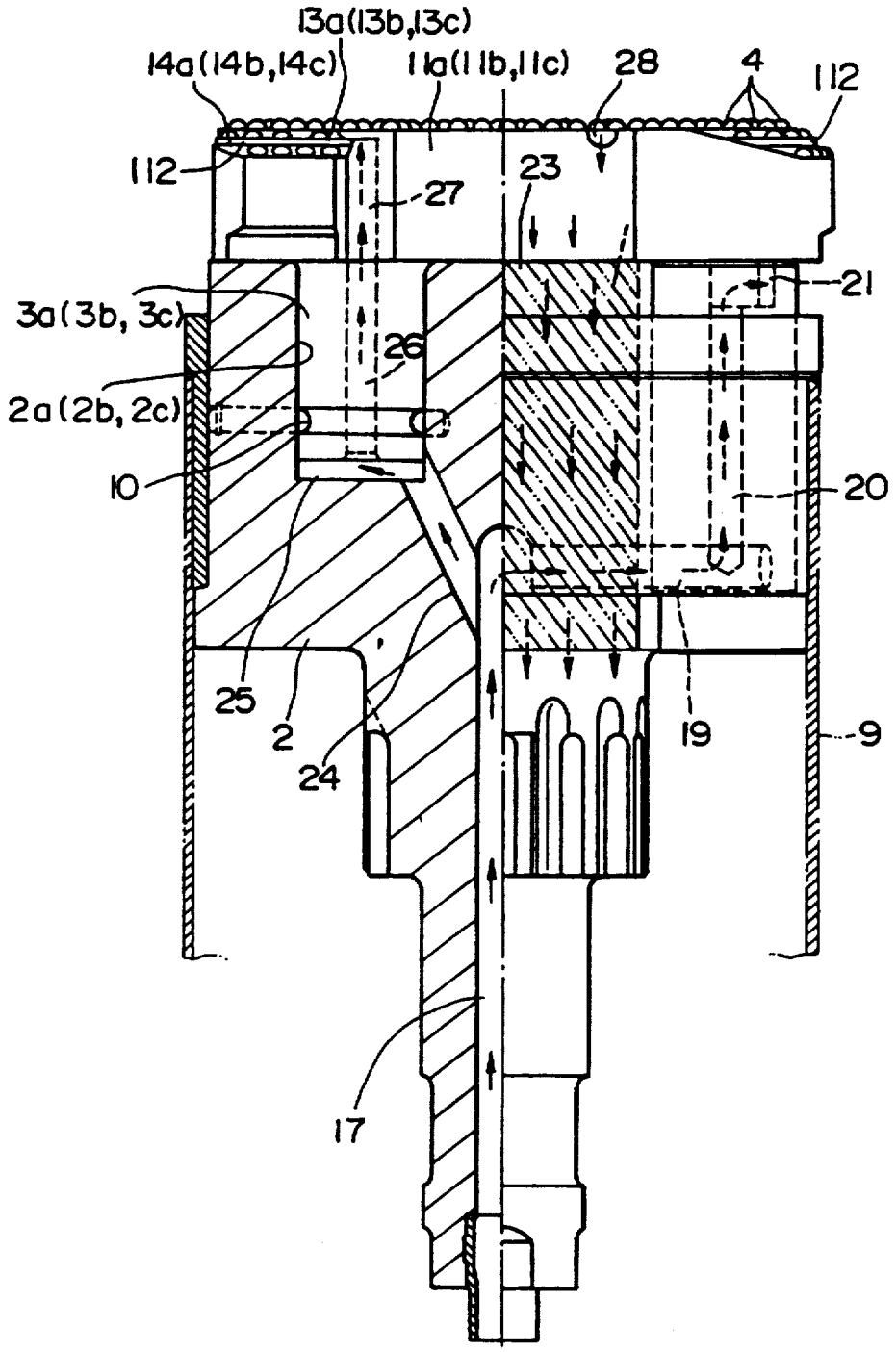
FIGS. 4 through 7 show a first preferred embodiment of the present invention.
Figure 5:
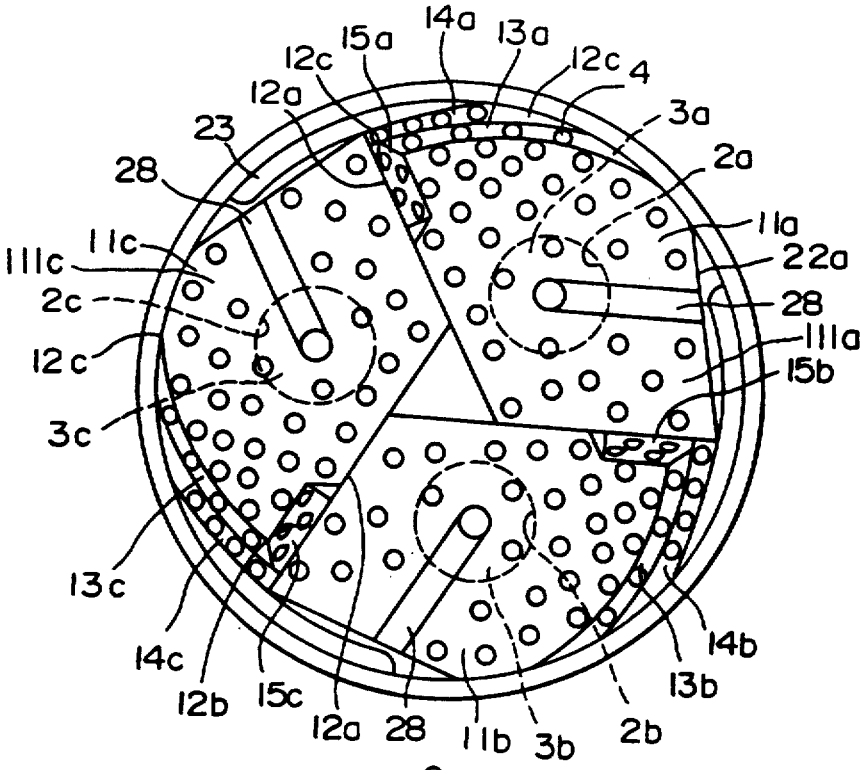
Figure 6:
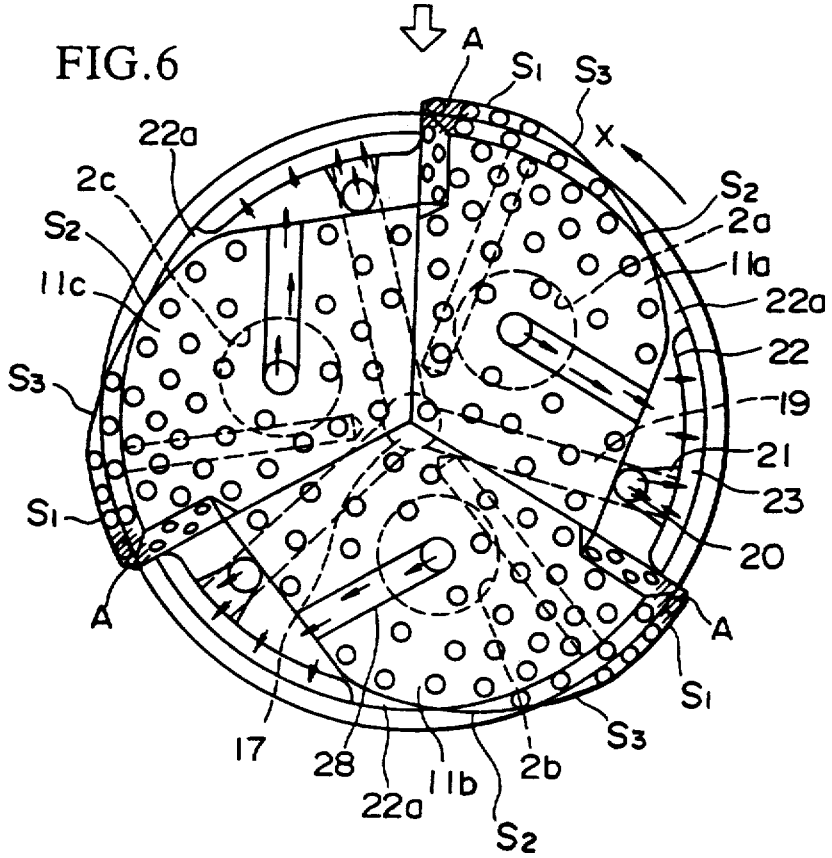

FIGS. 4 through 6 show a first preferred embodiment of an excavation tool in accordance with the present invention. The points of difference between the excavation tool shown in these diagrams and the excavation tool shown in FIGS. 1 through 3 are in the structure of the device and the blocks, so that only these parts will be explained, and depictions of the remaining structure in the diagrams, and explanations thereof, will be omitted here.

In the diagrams, reference numeral 2 indicates a device. Axle holes 2*a*, 2*b*, and 2*c* are formed in the bottom surface of device 2 in such a way that these holes are displaced from the center of device 2 and are placed at equal angles in the circumferential direction (at intervals of 120 degrees).

Block axles 3*a*, 3*b*, and 3*c* are engaged in axle holes 2*a*, 2*b*, and 2*c* in a freely rotatable and firmly attached manner. The firm attachment of block axles 3*a*, 3*b*, and 3*c* is accomplished, for example, by inserting a suspension pin from a side hole (not shown in the diagram) into the device in the state in which block axles 3*a*, 3*b*, and 3*c* are engaged in axle holes 2*a*, 2*b*, and 2*c*, and by connecting the suspension pin to a ring-form groove 10 which is formed on the outer circumference of the block axle.

Furthermore, reference numerals 11*a*, 11*b*, and 11*c* indicate blocks which are provided at the lead ends of block axles 3*a*, 3*b*, and 3*c* and perpendicular with respect to these block axles. It is permissible to form these blocks 11*a*, 11*b*, and 11*c* unitarily with block axles 3*a*, 3*b*, and 3*c*, or to form them separately and connect them by means of bolts or the like. These blocks 11*a*, 11*b*, and 11*c* have identical structures which have the shape of a fan when viewed from the bottom surface thereof, so that the radius of these fan shapes is so set as to be roughly equivalent of radius of device 2. The left and right side faces 12*a* and 12*b* of blocks 11*a*, 11*b*, and 11*c* are in mutual opposition, and moreover, the arc parts 12*c* of the blocks are so disposed as to together form roughly a circular shape. The left and right side faces 12*a* and 12*b* of blocks 11*a*, 11*b*, and 11*c* are formed with differing lengths and the angles formed by the side faces 12*a* and 12*b* measure 120 degrees.

The front end surfaces (bottom surfaces) of blocks 11*a*, 11*b*, and 11*c* are comprising level surfaces 111*a*, 111*b*, and 111*c* which are positioned on the side of block axles 3*a*, 3*b*, and 3*c* and perpendicular to block axles 3*a*, 3*b*, and 3*c*, first sloping surfaces 13*c*, which slope downwardly from the arc shaped ridge line of the level surfaces 111*a*, 111*b*, and 111*c* in the direction of the circumference of device 2, and second sloping surfaces 14a, 14b, and 14c, which slope downwardly from the arc-shape ridge line of the outer side of first sloping surfaces 13a, 13b, and 13c in the direction of the outer circumferential surface of device 2; moreover, a step 112 is provided between first sloping surfaces 13a, 13b, and 13c and second sloping surfaces 14a, 14b, and 14c. In this manner, by means of providing step 112, it is possible to maintain the spacing between bits 4 embedded in first sloping surfaces 13a, 13b, and 13c and second sloping surfaces 14a, 14b, and 14c, so that it becomes possible to embed a number of bits 4, and thus to increase the excavation efficiency.

Furthermore, when device 2 is rotated in the direction of excavation, as progress is made in the direction of rotation, sloping surfaces 15a, 15b and 15c, which gradually slope in the direction of the base edge side of the axial direction of device 2, are formed at the end parts of side faces 12a of the blocks which protrude beyond the outer circumferential surface of device 2. A plurality of bits 4... comprising superhardened chips are embedded in the lead end surfaces of the blocks 13a, 13b, and 13c, the surfaces 14a, 14b, and 14c, surfaces 15a, 15b, and 15c, and the sloping surfaces, and are perpendicular with respect to the various surfaces.

The relative positions of block axles 3a, 3b and 3c with respect to blocks 11a, 11b, and 11c are set so that at the time of the rotation of device 2 in the direction of excavation, blocks 11a, 11b, and 11c rotate as a result of the excavation resistance of the bottom part of the excavation hole, the intersecting part of one of the side faces of the block 12a and arc part 12c protrudes beyond the outer circumferential surface of device 2 by a predetermined excavation amount, and at this time, the side faces 12b and 12a of each block are in contact with the side faces 12a and 12b of the neighboring blocks.

Furthermore, the outer circumferences of the blocks 11a, 11b, and 11c are formed with arcs of differing radiuses.

That is, the outer circumferences of blocks 11a, 11b, and 11c are comprising, as shown in FIG. 6, two arcs S1 and S2 and a curve S3 which smoothly connects the arcs S1 and S2. Arcs S1 and S2 have an identical center, and the radius of arc S1 is set to be larger than the radius of arc S2. Furthermore, when the above-described arc S1 is rotated in the direction of excavation of device 2, this arc is positioned on the protruding side of the outer circumferential surface of device 2, while arc S2 is positioned so as to not protrude beyond the outer circumferential surface of device 2.

A plurality of bits 4 are embedded in the lead end surface of blocks 11a, 11b, and 11c; however, the radius of the outer circumference of the part of blocks 11a, 11b, and 11c which protrudes is larger than the radius of the outer circumference of the part which does not protrude, so that it is possible to embed a number of bits on the protruding side part. Accordingly, when device 2 is rotated in the direction of excavation, the amount of work of the protruding part of blocks 11a, 11b, and 11c is large, but a number of bits 4 are embedded in this part, so that it is possible to prevent the abrasion of the bits 4 which are embedded in the protruding part before the abrasion of the bits 4 which are embedded in the non-protruding part, and accordingly, it is possible to improve the lifespan of the excavation tool.

A air exhaust hole 17 which extends in the axial direction is formed at the center of device 2. This air exhaust hole 17 opens in the base end surface of device 2, and when the hammer piston descends, the air which is thereby compressed is emitted from this opening. Furthermore, in device 2, side holes 19, which extend in the outward radial direction and are connected to the lead end part of air exhaust hole 17, are formed passing between airholes 2a, 2b and 2c at intervals of 120 degrees. At the vicinity of the outer end parts of side holes 19, the sideholes are connected to airholes 20, which extend in the axial direction to the lead end side of device 2, and at the opening parts of airholes 20, which open in the bottom surface of the device, notches 21 are formed which gradually widen in the outward radial direction. The outer ends of notches 21 are connected to excavated matter exhaust grooves 23, which are formed at the outer circumferential surface of device 2 and between the device and the outer side excavation pipe 9. Excavated matter exhaust groove 23 is provided unitarily at the outer circumference of device 2, and is formed with an arc shape between projections 22a which are used for centering, which maintain a state in which the outer circumference of the device 2 has a center identical to that of the excavation pipe 9; excavated matter exhaust groove 23 and projections 22a are disposed alternately in the circumferential direction between device 2 and excavation pipe 9. The width dimension of excavated matter exhaust groove 23 is set within a fixed range so that only excavated matter of less than a predetermined size is able to pass therethrough, so that the excavated matter which passes through the excavated matter exhaust groove 23 and into excavation pipe 9 does not clog excavation pipe 9 so as to render it unusable.

Furthermore, connecting holes 24, which are connected to the bottom surface of axle holes 2a, 2b, and 2c, are formed in the lead end part of air exhaust holes 17 of device 2. Airspaces 25 are formed between the bottom surface of block axles 3a, 3b, and 3c, and axle holes 2a, 2b, and 2c airspaces 25 are connected to the bottom surface of the blocks through the medium of passage holes 26, which pass through the center part of block axles 3a, 3b, 3c, and passage holes 27, which pass vertically through blocks 11a, 11b, and 11c. Grooves 28, which are formed along the bottom surface of the blocks, extend from the openings of passage holes 27 in the bottom surface of blocks 11a, 11b, and 11c in an outward direction.

Next, the operation of the excavation tool having the above structure will be explained.

When a hammer cylinder 1 receives driving force and rotates in a direction X, device 2, the block axles, and the blocks rotate unitarily in the same direction.

Furthermore, when the hammer piston which is disposed within hammer cylinder 1 is operated and imparts a downward striking force to device 2, blocks 11a, 11b, and 11c are forced into the earth, and bits 4 excavate earth and sand by means of rotational force.

When hammer cylinder 1, device 2, and blocks 11a, 11b, and 11c rotate in the direction of excavation, blocks 11a, 11b, and 11c rotate about block axles 12a, 12b, and 12c as a result of excavation resistance, and one intersection part of side face 12a and arc part 12c of blocks 11a, 11b, and 11c protrudes beyond the outer circumferential surface of device 2, and this part serves as outer circumferential blade A. Furthermore, when blocks 11a, 11b, and 11c rotate, the side faces 12a and 12b of each block come into contact with the side faces 12b and 12a of the neighboring blocks, and this position acts as a stopper, so that further rotation of the blocks is controlled. In this state, blocks 11a, 11b, and 11c receive the rotational force of device 2 and excavate earth by means of the outer circumferential blades A and the like.

Here, three blocks are provided, so that three outer circumferential blades A, each corresponding to one block, are provided, and moreover, these outer circumferential blades A are disposed at equal intervals in the circumferential direction. As a result, it is possible to conduct balanced excavation, so that, for example, even in ground of uneven quality, hole bending is unlikely to occur.

Furthermore, at the time of excavation, the left and right side faces 12a and 12b of blocks 11a, 11b, and 11c are in contact with the side faces 12b and 12a of the neighboring blocks, and the block axles 3a, 3b, and 3c which are fixed to the blocks are engaged with and supported by axle holes 2a, 2b, and 2c, so that blocks 11a, 11b, and 11c are supported at three points. Accordingly, the attachment of the blocks 11a, 11b, and 11c is strong, and excavation can be conducted without the occurence of rattling therein.

Furthermore, at the time of excavation, as shown in FIG. 6, when a excavation counterforce C which is parallel to a side face 12a is placed upon one block 11a from the inner circumferential surface of the excavation hole, this excavation counterforce C acts upon the block axle 3a, which is unitary in structure with the block, and in addition, acts on another block 11b through the medium of the side faces 12b and 12a, which are in mutual contact. In this manner, even when a parallel force is placed on one side face 12a of a block, this force is distributed to block axle 3a and another block 11b, so that the load placed on one block axle 3a becomes smaller by this amount. Therefore, it is possible to reduce the load which is placed on one block axle 3a (3b, 3c), so that an advantage is gained in that the diameter of the block axles can be made smaller.

In addition, when the piston within hammer cylinder 1 descends, the air which is compressed by this hammer piston flows into supply hole 17, and is blown onto the bottom surface of blocks 11a, 11b, and 11c through the medium of airspaces 25, which are formed between the axle holes and the block axles, and passage holes 26 and 27, and the excavated matter is thus removed from the blocks. Then, the excavated matter which has been removed from the blocks moves along with the compressed gas from the excavated matter exhaust hole 23 and into excavation pipe 9, and is then expelled in an upward direction. A portion of the compressed air supplied to air supply hole 17 is blown onto the excavated material exhaust hole 23 which is positioned at the outer circumference of device 2, through the medium of side holes 19 and vertical holes 20. Moving along with the flow of compressed air, the excavated matter in the vicinity enters excavated matter exhaust hole 23, so that the expulsion of the excavated matter is conducted smoothly.

Figure 7:
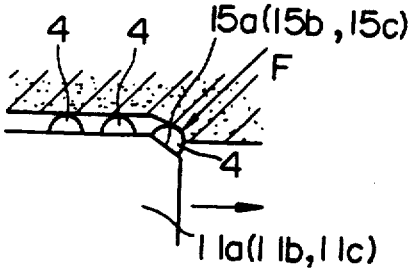

Furthermore, at the time of excavation, as shown in FIG. 7, the combined force F of the rotational counterforce and the counterforce of the striking force, which is perpendicular to the rotational counterforce, acts in the most inclined manner, with respect to the vertical axis, on the bits 4 which are embedded in sloping surfaces 15a, 15b and 15c; however, these bits 4 are embedded in sloping surfaces 15a, 15b and 15c, so as to be roughly perpendicular to the surfaces, so that the above-described combined force F acts at right angles to the bits 4, and accordingly, it is possible to prevent damage to or removal of the bits 4.

After excavation has been completed, the hammer cylinder is rotated in a direction which is opposite to that of the direction of excavation; however, at this time, the blocks 11a, 11b and 11c rotate in a direction opposite to that of the time of excavation, and as shown in FIG. 2, the arc parts 12c, which are positioned at the extreme circumference of the blocks, have a position which is equivalent to that of the bottom surface of device 2, or is within this position. As it is possible to slide the tool along the interior of excavation pipe 9, by proceeding in this manner, it is possible to withdraw the excavation tool by pulling the hammer cylinder 1 upward.

Furthermore, excavated matter exhaust grooves 23 and projections 22a, which are for centering and are provided in a unitary manner along the outer circumference of device 2, are disposed alternately in the circumferential direction between device 2 and exhaust pipe 9, which is on the outer side thereof, so that it is possible to dispose the requisite number of exhaust passages for the conducting of excavated matter into excavation pipe 9 along the outer circumference of device 2, so that the excavated matter exhaust efficiency can be improved.

In addition, in comparison with the case in which projections 22a for the centering of the device and excavated matter exhaust grooves 23 are disposed in a displaced manner with respect to the length direction of device 2, for example, in comparison with the case in which the projections for the centering of the device are located at the base end side of the device and a ring-shaped groove for excavated matter exhaust is provided at the lead end of the device, the rattling of the device 2 during excavation is reduced, and the trapping of excavated matter between device 2 and excavation pipe 9 is prevented.

In addition, in comparison with the above-described case in which the projections 22A for the centering of the device 2 and the excavated matter exhaust grooves 23 are disposed in a displaced fashion with respect to the length direction of device 2, the length of device 2 can be reduced, and the overall structure can be made more compact.

In the above-described preferred embodiment, an explanation was given of a case in which three blocks 11A, 11B and 11C were provided; however, this is not necessarily so limited, and the present invention can also be applied to tools having four or more blocks.

Furthermore, in the above-described preferred embodiment, the left- and right-sided surfaces 12a and 12b of blocks 11a, 11b and 11c were formed in a flat manner. However, this is not necessarily so limited, and it is acceptable to form the side faces 12a and 12b in the shape of mutually joining arcs.

Furthermore, in the above-described first preferred embodiment, either a structure in which the blocks and block axles are formed unitarily, or a structure in which the blocks and block axles are formed separately and then joined is permissible.

Next, an example will be given of preferred embodiments of a case in which the blocks and block axles are formed separately and then are joined.

Figure 8:
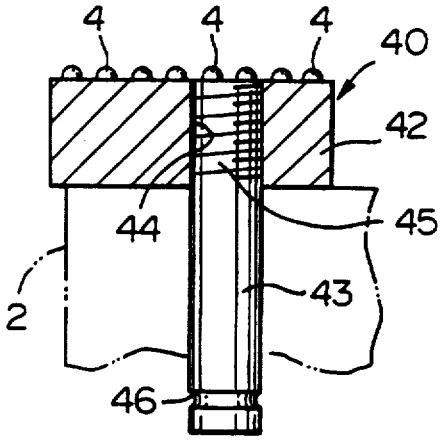
FIG. 8 is a cross-sectional view of the main parts of an excavation tool in accordance with a second preferred embodiment of the present invention.
Figure 9:
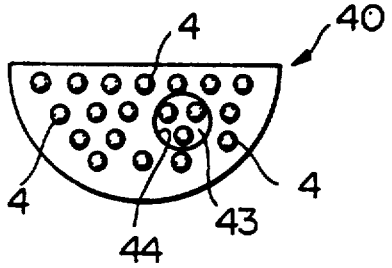
FIG. 9 is a top view of the same.

FIGS. 8 and 9 show a second preferred embodiment. In these diagrams, reference numeral 40 indicates an excavation head. This excavation head 40 is primarily comprising block 42 and block axle 43, which is removably attached to this block 42.

The above-described block 42 has a plate form with a roughly semicircular shape when viewed from the level surface side thereof, and on the upper surface thereof, a plurality of bits 4... comprising superhardened chips are embedded. Furthermore, a screw hole 44, which passes from the upper surface of block 42 to the lower surface of the block, is formed in block 42.

On the other hand, the above-described block axle 43 has a cylindrical shape, and in the lead-end surface thereof, bits 4... are embedded. Furthermore, on the outer circumference of the lead end of block axle 43, a male screw 45 is formed which screws into the above-described screw hole 44, and on the outer circumference of the basin thereof, a groove 46, which is engaged by a pin in order to prevent the removal of the block axle from device 2, is formed along the circumferential direction of the block axle.

The above-described excavation head 40 is formed by means of the insertion of block axle 43 into screw hole 44 of block 42, and the screwing-in of the male screw 45 formed on the outer circumference of the upper end.

In accordance with the above-described excavation tool, the excavation head 40 has a block construction comprising block 42 and block axle 43, which is removably screwed into this block 42, so that in the case in which the excavation head 40 is manufactured, it is possible to manufacture the block 42 and block axle 43 separately. Accordingly, the conventional difficulties involved in the process of the unitary formation of the excavation head 40 are solved, so that as a result, the manufacturing costs of the excavation tool can be kept low.

Figure 10:
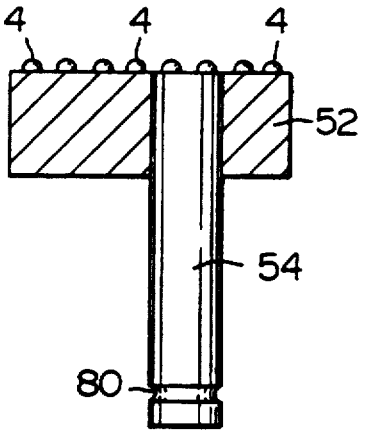
FIG. 10 is a vertical cross-sectional view of the main part of an excavation tool in accordance with a third preferred embodiment.

A third preferred embodiment is shown in FIG. 10. The third preferred embodiment shown in this diagram is a modification of the structure of the second preferred embodiment; the block axle 54 is joined to block 52 by means of interference fitting.

In accordance with the excavation tool of the present preferred embodiment, there is no need to form screw threads on block axle 54 and block 52 as in the case of the above-described second preferred embodiment, so that an advantage is gained in that the manufacture of block 52 and block axle 54 become simple.

Figure 11:
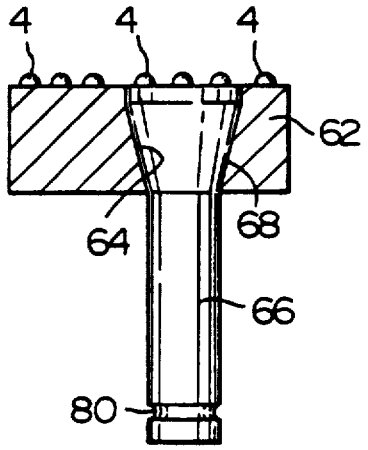
FIG. 11 is a vertical cross-sectional view of the main parts of an excavation tool in accordance with a fourth preferred embodiment.

A fourth preferred embodiment is shown in FIG. 11. The fourth preferred embodiment shown in the diagram represents a modification of the structure of the third preferred embodiment. In block 62 in FIG. 11, a tapered hole 64 is formed which gradually widens in diameter as it approaches the lead end surface. A tapered part 68 which comes into contact with the above-described tapered hole 64 is formed at the upper end of block axle 66.

In accordance with the excavation tool of the present preferred embodiment, in comparison with the case of the third preferred embodiment, an advantage is gained in that the accuracy of attachment and strength of attachment of block axle 66 with respect to block 62 are improved.

Figure 12:
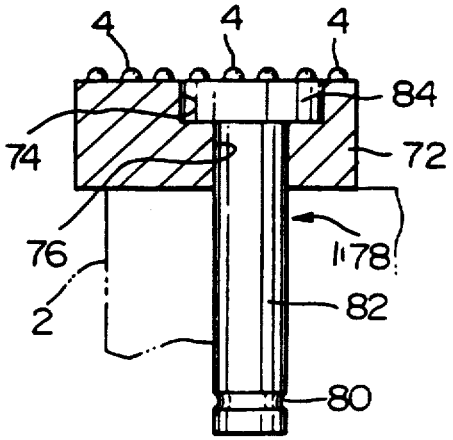
FIG. 12 is a vertical cross-sectional view of the main parts of an excavation tool in accordance with the fifth preferred embodiment.

FIG. 12 shows a fifth preferred embodiment. The fifth preferred embodiment shown in this diagram is a modification of the structure of the third preferred embodiment.

In the lead end surface of block 72, a hole 74 which has a circular shape and a depth which is one third of that of the block 72 is formed, and in the bottom surface of this hole 74, a hole 76 is formed which has an opening in the base end surface of block 72, is coaxial with hole 74, and has a smaller diameter than hole 74.

On the other hand, the block axle 78 which is combined with the above-described block 72 is comprising an axial part 82, which has a cylindrical shape and in the base end outer circumference of which a groove 80 is formed, and a head part 84, which is formed at the lead end part of this axial part 82 and has a greater diameter than axial part 82.

Block 72 is affixed by means of the insertion of axial part 82 of block axle 78 into hole 74, and the engaging of head part 84 of block axle 78 with hole 74 of block 72.

In accordance with the excavation tool of this preferred embodiment, block 72 is supported between head part 84 of block axle 78 and the bottom surface of the above-described device 2, so that an advantage is gained in that there is no need to form a screw thread between head part 82 of block axle 78 and hole 74 of block 72, as in the second preferred embodiment, or to conduct processes such as interference fitting as in the third preferred embodiment.

Figure 13:
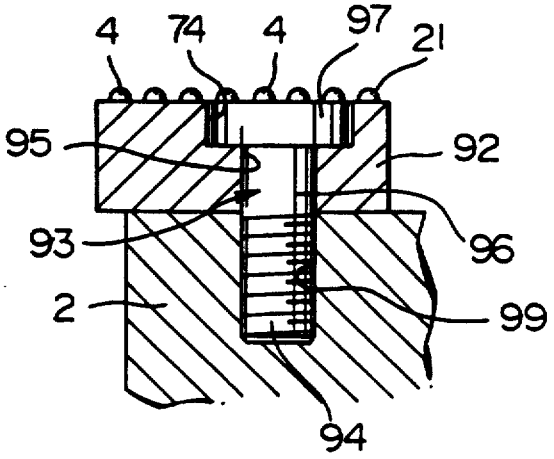
FIG. 13 is a vertical cross-sectional view of the main parts of an excavation tool in accordance with a sixth preferred embodiment.

FIG. 13 shows a sixth preferred embodiment. The excavation tool shown in the diagram is comprising, in the same manner as the above-described fifth preferred embodiment, block 92 and block axle 93.

Block axle 93 has formed, on the outer circumferential surface of the base end thereof, male screw 94, and this block axle comprises axial part 96, which is inserted freely slidably into hole 95 of the above-described block 92, and head part 97, which is formed at the lead end part of the axial part 96, has a larger diameter than axial part 96, and is engaged freely slidably in hole 74 of block 92.

Formation is accomplished by means of the insertion of axial part 96 of block axle 93 into hole 95 of block 92, and by the engaging of head part 97 of block axle 93 and hole 74 of block 92. Furthermore, axial part 96 is attached by means of the screwing of male screw 94 of axial part 96 into screw hole 99 formed in the bottom surface of device 2, and when device 2 rotates in the direction of excavation, block 92 rotates about block axle 93, and protrudes beyond the outer circumference of device 2 by a predetermined amount.

In this preferred embodiment, block axle 93 is affixed by means of being screwed into device 2, so that an advantage is gained in that no rattling is produced in block axle 93 and block 92.

Figure 14:
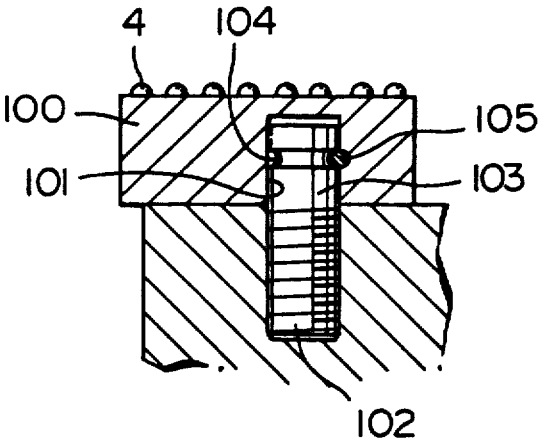
FIG. 14 is a cross-sectional view of the main parts of an excavation tool in accordance with a seventh preferred embodiment.

FIG. 14 shows a seventh preferred embodiment. In the excavation tool shown in the diagram, a hole 101 is formed in the base end surface of block 100, which does not reach the lead end surface thereof, the lead end part of a cylindrical block axle 103, which has formed on the base end outer circumference thereof a male screw 102, is inserted into this hole 101, a groove 104 is formed in this lead end part in the circumferential direction, a pin 105 is inserted into this groove 104 from a pinhole which is formed in block 100, and the block axle is thereby connected; the removal of block axle 103 from block 100 is prevented by pin 105, and block 100 is thus made rotatable about block axle 103.

In the excavation tool of this preferred embodiment, block axle 103 is not exposed at the lead end surface of block 100, so that an advantage can be gained in that wear resulting from contact with excavated matter is prevented.

In the excavation tools of the second and seventh preferred embodiments above, the blocks and block axles are formed as separate parts. By precisely combining the materials which comprise these parts, it is possible to increase the dependability of the tool.

The following are examples of the qualities required for the blocks.

(1) They should not wear down quickly as a result of contact with rock layers in the earth (resistance to wear).

(2) As it is necessary to form a number of holes for the setting of the bits, they should be machine-manufacturable (machine manufacturability).

In contrast, in comparison with the blocks themselves, the block axles rarely come into contact with rock, and so a low resistance to wear is permissible. Furthermore, the block axles have a simple shape in comparison with the blocks, so that poor machine-manufacturability is also acceptable. However, as the block axles are repeatedly deformed by excavation, a high fatigue strength is necessary. Accordingly, in the blocks, in order to achieve ideal resistance to wear, hardened, tempered materials are generally used, and in the block axles, in order to raise fatigue strength, it is preferable to use surface-hardened materials in which the surface alone has been hardened by means of a carburizing process or the like.

For example, the blocks are formed by steel which contains nickel, chromium, molybdenum, and has a high carbon content and subjecting this to a hardening and temperizing process, and the block axles are formed by steel which contains nickel, chromium, molybdenum, and has a low carbon content and subjecting this to carburization.

What is claimed is:

1. An excavation tool, in which a device is provided which receives a striking force of a hammer and a rotational force of a hammer cylinder, in a bottom surface of which at least three axle holes are provided displaced from a center of said device and at equivalent angular intervals in a circumferential direction, block axles are engaged in said axle holes in a freely rotatable manner, blocks which are roughly fan-shaped and have bits embedded in lead end surfaces thereof are provided at lead end parts of said block axles, so that left- and right-side faces of said blocks are in mutual opposition and arc parts of all said blocks together form roughly a circle shape; and when said device is rotated in a direction of excavation, said blocks rotate as a result of resistance to excavation of a bottom part of an excavation hole, one intersection part of side faces and arc parts of said blocks protrudes beyond an outer circumferential surface of said device by a predetermined excavation amount, and mutual positions of said block axles with respect to said blocks are so determined that both side faces of each said block come into contact with side faces of neighboring blocks at this time.

2. An excavation tool in accordance with claim 1, in which excavated matter exhaust grooves and projections used for centering, which are provided unitarily at an outer circumference of said device, are disposed alternately in a circumferential direction between said device and an excavation pipe on an outer side thereof.

3. An excavation tool, in which a device is provided which receives a striking force of a hammer and a rotational force of a hammer cylinder, in a bottom surface of which at least three axle holes are provided displaced from a center of said device and at equivalent angular intervals in a circumferential direction, block axles are engaged in said axle holes in a freely rotatable manner, blocks which are roughly fan-shaped and have bits embedded in lead end surfaces thereof are provided at lead end parts of said block axles, so that left- and right-side faces of said blocks are in mutual opposition and arc parts of all said blocks together form roughly a circle shape; and when said device is rotated in a direction of excavation, said blocks rotate as a result of resistance to excavation of a bottom part of an excavation hole, one intersection part of side faces and arc parts of said blocks protrudes beyond an outer circumferential surface of said device by a predetermined excavation amount, and mutual positions of said block axles with respect to said blocks are so determined that both side faces of each said block come into contact with side faces of neighboring blocks at this time, and furthermore, an air exhaust hole which extends in an axial direction is formed in a center of said device, passage holes having openings in lead end surfaces of said blocks and which extend in an axial direction are formed in said block axles, a depth of said axle holes is set so as to be larger than a length of said block axles, and connecting holes connecting said air exhaust hole and axle holes are formed in said device.

4. An excavation tool in accordance with claim 3, in which grooves are formed in a lead end surface of said blocks, leading from edges of openings of said passage holes to said excavated matter exhaust grooves.

5. An excavation tool, in which a device is provided which receives a striking force of a hammer and a rotational force of a hammer cylinder, in a bottom surface of which at least three axle holes are provided displaced from a center of said device and at equivalent angular intervals in a circumferential direction, block axles are engaged in said axle holes in a freely rotatable manner, blocks which are roughly fan-shaped and have bits embedded in lead end surfaces thereof are provided at lead end parts of said block axles, so that left- and right-side faces of said blocks are in mutual opposition and arc parts of all said blocks together form roughly a circle shape; and when said device is rotated in a direction of excavation, said blocks rotate as a result of resistance to excavation of a bottom part of an excavation hole, one intersection part of side faces and arc parts of said blocks protrudes beyond an outer circumferential surface of said device by a predetermined excavation amount, and mutual positions of said block axles with respect to said blocks are so determined that both side faces of each said block come into contact with side faces of neighboring blocks at this time, and furthermore, an air exhaust hole which extends in an axial direction is formed in a center of said device, said air exhaust hole is connected through the medium of side holes to air holes which reach and have openings in a bottom surface of said device, and in addition, excavated matter exhaust grooves are formed in an outer circumferential surface of said device and notches which connect said excavated matter exhaust grooves and air holes are provided in a bottom surface of said device.

6. An excavation tool, in which a device is provided which receives a striking force of a hammer and a rotational force of a hammer cylinder, in a bottom surface of which at least three axle holes are provided displaced from a center of said device and at equivalent angular intervals in a circumferential direction, block axles are engaged in said axle holes in a freely rotatable manner, blocks which are roughly fan-shaped and have bits embedded in lead end surfaces thereof are provided at lead end parts of said block axles, so that left- and right-side faces of said blocks are in mutual opposition and arc parts of all said blocks together form roughly a circle shape; and when said device is rotated in a direction of excavation, said blocks rotate as a result of resistance to excavation of a bottom part of an excavation hole, one intersection part of side faces and arc parts of said blocks protrudes beyond an outer circumferential surface of said device by a predetermined excavation amount, and mutual positions of said block axles with respect to said blocks are so determined that both side faces of each said block come into contact with side faces of neighboring blocks at this time, and furthermore, at one intersection point of side faces and lead end surfaces of said blocks, sloping surfaces are provided which slope with respect to these surfaces, and a part of said bits are embedded in said sloping surfaces in a vertical manner with respect to said sloping surfaces.

7. An excavation tool, in which a device is provided which receives a striking force of a hammer and a rotational force of a hammer cylinder, in a bottom surface of which at least three axle holes are provided displaced from a center of said device and at equivalent angular intervals in a circumferential direction, block axles are engaged in said axle holes in a freely rotatable manner, blocks which are roughly fan-shaped and have bits embedded in lead end surfaces thereof are provided at lead end parts of said block axles, so that left- and right-side faces of said blocks are in mutual opposition and arc parts of all said blocks together form roughly a circle shape; and when said device is rotated in a direction of excavation, said blocks rotate as a result of resistance to excavation of a bottom part of an excavation hole, one intersection part of side faces and arc parts of said blocks protrudes beyond an outer circumferential surface of said device by a predetermined excavation amount, and mutual positions of said block axles with respect to said blocks are so determined that both side faces of each said block come into contact with side faces of neighboring blocks at this time, and furthermore, outer circumferences of said blocks are formed by arcs having differing radiuses, and when said device rotates in said direction of excavation, a radius of an outer circumference of said blocks on a side which protrudes beyond said outer circumferential surface of said device is set so as to be larger than a radius of an outer circumference of said blocks on a side which does not protrude.

8. An excavation tool, in which a device is provided which receives a striking force of a hammer and a rotational force of a hammer cylinder, in a bottom surface of which at least three axle holes are provided displaced from a center of said device and at equivalent angular intervals in a circumferential direction, block axles are engaged in said axle holes in a freely rotatable manner, blocks which are roughly fan-shaped and have bits embedded in lead end surfaces thereof are provided at lead end parts of said block axles, so that left- and right-side faces of said blocks are in mutual opposition and arc parts of all said blocks together form roughly a circle shape; and when said device is rotated in a direction of excavation, said blocks rotate as a result of resistance to excavation of a bottom part of an excavation hole, one intersection part of side faces and arc parts of said blocks protrudes beyond an outer circumferential surface of said device by a predetermined excavation amount, and mutual positions of said block axles with respect to said blocks are so determined that both side faces of each said block come into contact with side faces of neighboring blocks at this time, and furthermore, said block axles and said blocks are joined in a mutually detachable fashion.

9. An excavation tool in accordance with claim 8, in which said block axles and said blocks comprise different materials.

10. An excavation tool in accordance with claim 8, in which a fatigue strength of said block axles is set to be greater than a fatigue strength of said blocks.

11. An excavation tool, in which a device is provided which receives a striking force of a hammer and a rotational force of a hammer cylinder, in a bottom surface of which at least three axle holes are provided displaced from a center of said device and at equivalent angular intervals in a circumferential direction, block axles are engaged in said axle holes in a freely rotatable manner, blocks which are roughly fan-shaped and have bits embedded in lead end surfaces thereof are provided at lead end parts of said block axles, so that left- and right-side faces of said blocks are in mutual opposition and arc parts of all said blocks together form roughly a circle shape; and when said device is rotated in a direction of excavation, said blocks rotate as a result of resistance to excavation of a bottom part of an excavation hole, one intersection part of side faces and arc parts of said blocks protrudes beyond an outer circumferential surface of said device by a predetermined excavation amount, and mutual positions of said block axles with respect to said blocks are so determined that both side faces of each said block come into contact with side faces of neighboring blocks at this time, and furthermore, said lead end surfaces of said blocks are provided with level surfaces, which are positioned on a block axle side, and are perpendicular to said block axles, first sloping surfaces, which slope downwardly from arc-form ridge lines of said level surfaces in a direction of an outer circumference side of said device, and second sloping surfaces, which slope downwardly from outer side arc-form ridge lines of said first sloping surfaces in the direction of said outer circumference side of said device, and moreover, a step is provided between said first and second sloping surfaces.

* * * * *

UNITED STATES PATENT AND TRADEMARK OFFICE

CERTIFICATE OF CORRECTION

PATENT NO. : 5,139,099

DATED : August 18, 1992

INVENTOR(S) : Takeshi Hayashi, et al.

It is certified that error appears in the above-identified patent and that said Letters Patent is hereby corrected as shown below:

Column 1, line 11: "toll" should read as --tool--

Column 5, line 55: "tool,," should read as --tool,--

Signed and Sealed this

Twenty-eighth Day of September, 1993

*Attest:*

*Attesting Officer*

BRUCE LEHMAN

*Commissioner of Patents and Trademarks*